US006976333B2

(12) United States Patent
Sims

(10) Patent No.: US 6,976,333 B2
(45) Date of Patent: Dec. 20, 2005

(54) RECOIL REDUCING ACCESSORIES FOR FIREARMS

(76) Inventor: Steven Sims, 1141 E. Agate Loop Rd., Shelton, WA (US) 98584

( * ) Notice: Subject to any disclaimer, the term of this patent is extended or adjusted under 35 U.S.C. 154(b) by 0 days.

(21) Appl. No.: 09/870,178

(22) Filed: May 29, 2001

(65) Prior Publication Data

US 2002/0088161 A1 Jul. 11, 2002

Related U.S. Application Data

(60) Provisional application No. 60/261,293, filed on Jan. 11, 2001.

(51) Int. Cl.[7] ..... F41C 23/08
(52) U.S. Cl. ..... 42/74
(58) Field of Search ..... 42/74

(56) References Cited

U.S. PATENT DOCUMENTS 490,129 A * 1/1893 Tredway et al. ..... 42/74
1,213,951 A * 1/1917 Ringsmith ..... 42/74
1,328,700 A * 1/1920 Wagoner ..... 42/74
1,805,273 A * 5/1931 Ammann ..... 42/74
4,922,641 A * 5/1990 Johnson ..... 42/74
5,362,046 A * 11/1994 Sims ..... 473/300
5,375,360 A * 12/1994 Vatterott ..... 42/74

* cited by examiner

*Primary Examiner*—Michael J. Carone
*Assistant Examiner*—Gabriel S. Sukman
(74) *Attorney, Agent, or Firm*—Richard D. Multer

(57) ABSTRACT

Accessories for firearms. They are designed to reduce the recoil felt by the shooter when a firearm is discharged. The accessories meet this goal by modifying the decay pattern of vibrations set up in the stock when the firearm is discharged. Kick may be further reduced by elastic compression and also by pneumatic compression of air in sealed pockets formed in and by accessory components.

7 Claims, 9 Drawing Sheets

RECOIL REDUCING ACCESSORIES FOR FIREARMS

RELATION TO A COPENDING APPLICATION

This application is related to, and copending with, provisional application No. 60/261,293 filed 11 Jan. 2001. The benefit of the filing date of the provisional application is claimed.

TECHNICAL FIELD OF THE INVENTION

In one respect the present invention relates to novel, improved devices (or accessories) for reducing the recoil (or kick) of firearms which the shooter experiences when a firearm is discharged by modifying the decay pattern of the vibrations set up in the firearm when it is fired.

In another respect the present invention relates to accessories as defined in the preceding paragraph which further reduce the kick experienced by the shooter by resilient compression of an elastomeric component or by that mechanism and the pneumatic compression of air in sealed pockets of the accessory.

BACKGROUND OF THE INVENTION

Shoulder-fired guns such as shotguns and rifles kick (i.e., recoil) when the gun is fired. Particularly if the gun is one of larger caliber, or is fired automatically, or if a round of wildcat or other ammunition of heavier charge is fired, the magnitude of the recoil can be large enough to throw off the shooter's aim and can even lead to serious injury.

A variety of gunstock-mounted pads designed to mitigate this problem are commercially available, and many others are described in the patent literature and elsewhere. Previous solutions to the kick problem are less than satisfactory, in a major respect because they are not equipped to handle the particular type of vibrations set up in the stock when a gun is fired. Instead, their design is predicated on the erroneous assumption that "cushioning" is the best, if not the only, way of reducing recoil.

"Cushioning" devices are less than satisfactory because they do not focus on the phenomenon—impact—which is felt as a kick by the shooter when a firearm is discharged. Impact is a particular phenomenon in the general field of shock and vibration. An important characteristic of an impact is the presence of relatively large forces (or shock) at points of contact. In contrast to vibration, mechanical shock is of relatively short duration (a few milliseconds in the case of a firearm firing smokeless powder) and dies away rapidly. Cushioning, by itself, is not capable of dealing with these short duration, high magnitude shock vibrations to an extent necessary to provide the wanted reduction in kick or recoil.

The search for an effective recoil reducing firearm accessory continues.

SUMMARY OF THE INVENTION

Disclosed herein are novel recoil reducing accessories which modify the decay pattern and reduce the amplitude of the vibrations set up in its stock and transferable to the shooter as a kick when a gun is fired, particularly the sudden and high magnitude vibrations which characterize the shock generated when the firearm is discharged. The result is a marked decrease in the kick experienced by the shooter.

The novel recoil reducing accessories of the present invention have two complementary components. One is a pad which fits against the shoulder of the shooter and is fabricated from an elastomeric (or viscoelastic) material. The complementary component is a rigid plate to which one or more vibration pattern decay modifiers are attached.

These decay pattern modifiers are preferably of the character disclosed in U.S. Pat. No. 5,362,046. They have a mushroom-like configuration defined by a stem and an integral head. That end of the stem opposite the head of the decay pattern modifier is fixed to the butt-associated plate of the recoil reducing accessory and is configured for vibration in directions which encompass a 360 degree arc and are generally normal to the longitudinal axis of the decay pattern modifier. The head of the modifier is dimensioned and configured for free vibrational bending of its peripheral edge at all loci around the circumference thereof in first and second, opposite directions generally paralleling the longitudinal axis of the accessory. The free end of the (or each) decay pattern modifier—i e., the end opposite the head—is attached to the plate of the component with an adhesive or in any other desired manner.

With the recoil reducing accessory assembled, each decay pattern modifier is seated in a recess or cavity formed in the elastomeric pad. These recesses are so dimensioned that the decay pattern modifier elements are free to move in and about the recesses in the manner discussed above. The result of the decay pattern modifier movement is a marked modification of the vibration decay pattern and a consequent reduction in the kick felt by the shooter.

Also, as the gun is discharged, the elastomeric pad of the accessory elastically compresses, thus cushioning the impact and further reducing the recoil felt by the shooter. Due to the material from which it is formed, the pad itself may also beneficially modify the decay pattern of the shock vibrations set up in the gunstock when the gun is fired.

In one currently preferred embodiment of the invention, those cavities in the elastomeric pad which house decay pattern modifiers are sealed when the plate of the accessory is assembled to the pad. As a consequence, the accessory also provides pneumatic cushioning by the compression of the air in such pockets when the firearm is discharged.

The modifier housing cavities (and others) in the elastomeric pad also "hollow out" the elastomeric, pad, increasing its compressibility and ability to reduce recoil.

Thus, accessories embodying the principles of the present invention may reduce the adverse effects experienced by the shooter when a firearm is discharged by mechanisms, including, but not necessarily limited to: (1) modification of the decay pattern of the shock vibrations set up in the gunstock when the gun is discharged; (2) reduction of the amplitude of those shock vibrations; (3) cushioning of the discharge-generated impact by compression of the elastically deformable accessory component, and (4) pneumatic cushioning by compression of the air in sealed pockets of the accessory. In all devices embodying the principles of the invention, at least the first three of these mechanisms come into play and significantly reduce the kick felt by the shooter.

The novel accessories disclosed herein can, in different embodiments, be constructed for attachment to the end of a gunstock or so that they can be slipped onto the stock. They can be provided in versions which are customized for particular gunstocks and versions which can be contoured to fit the stock after they have been installed.

The objects, features, and advantages of the present invention will be apparent to the reader from the foregoing and the appended claims and as the ensuing detailed description and discussion of the invention proceeds in conjunction with the accompanying drawing.

DETAILED DESCRIPTION OF THE INVENTION

Figure 1:
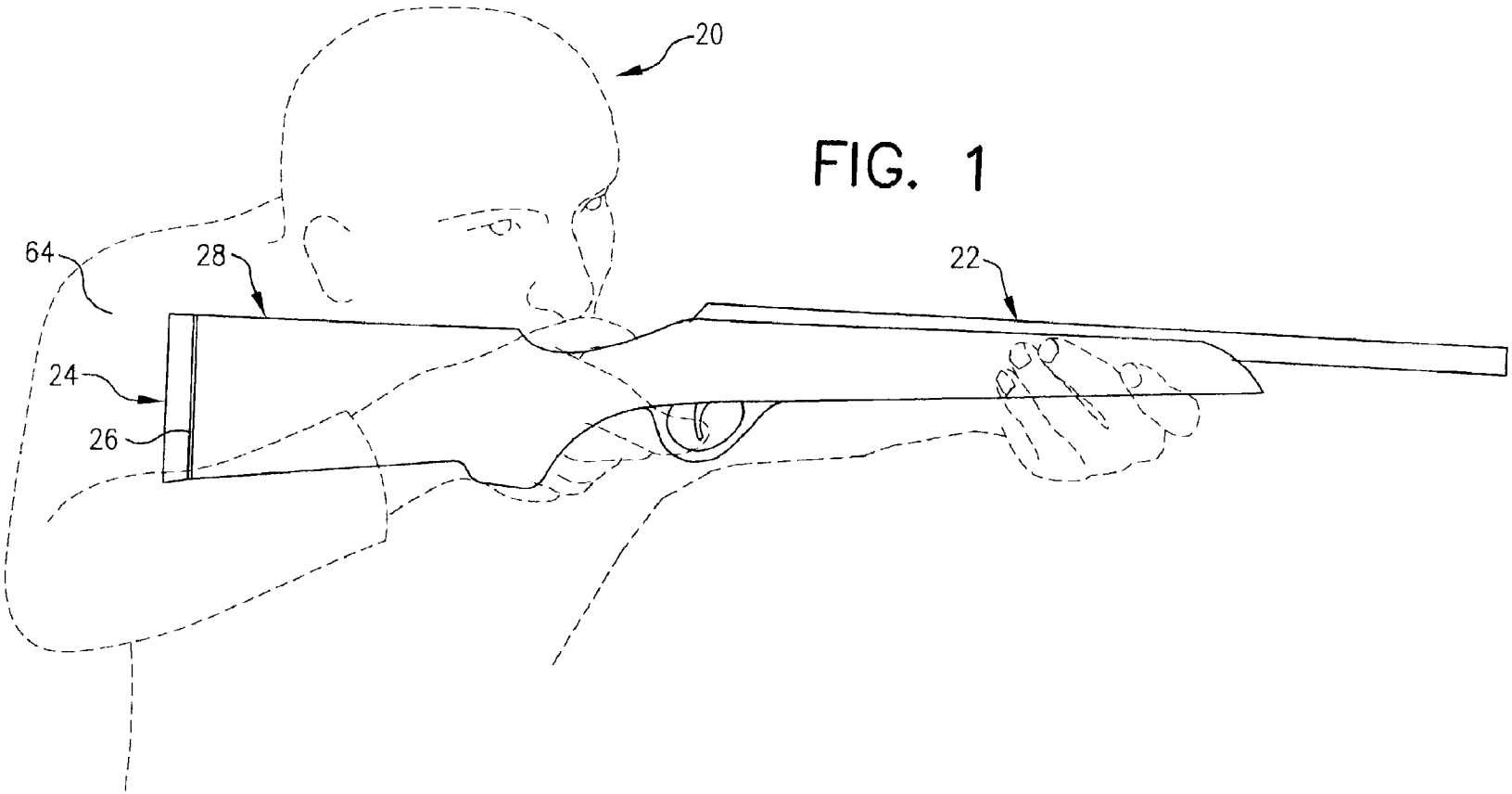
FIG. 1 is a pictorial view of a shooter holding a firearm equipped with a recoil reducing accessory embodying the principles of the present invention.

Referring now to the drawings, FIG. 1 depicts a shooter 20 in the act of firing gun 22. Gun 22 is equipped with a recoil (or kick) reducing accessory 24 embodying the principles of the present invention. Accessory 24 is mounted to the butt end 26 of the gun's stock 28.

Figure 2:
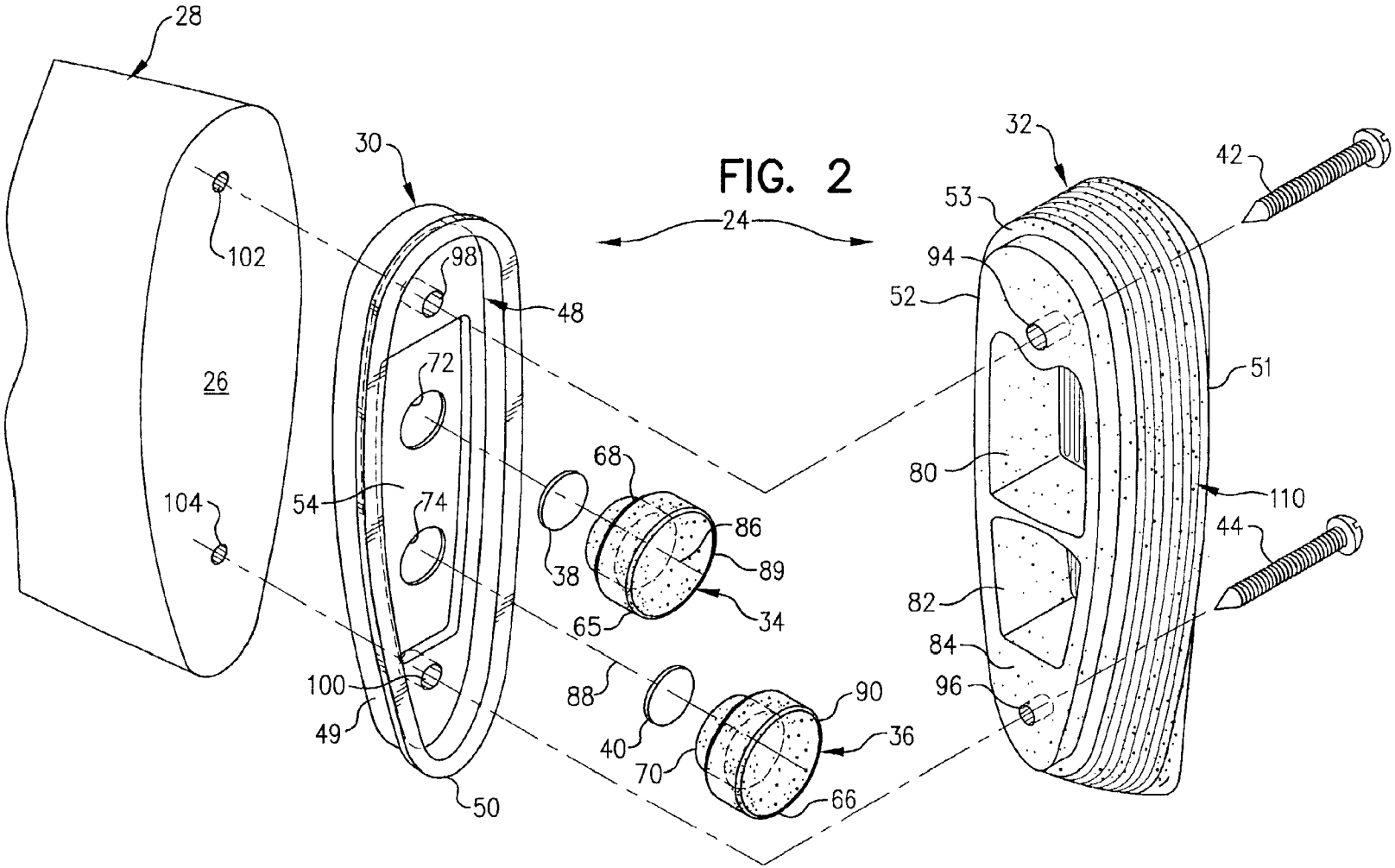
FIG. 2 is an exploded view of the recoil reducing accessory illustrated in FIG. 1.
Figure 2A:
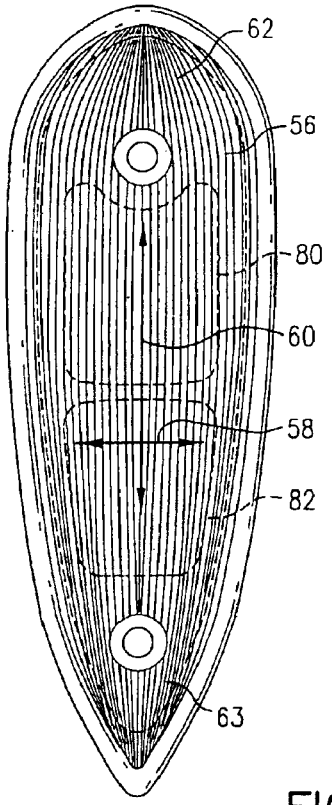
FIG. 2A is an end view of the FIG. 1 accessory, showing that surface of an elastomeric accessory component which engages the shooter's shoulder.
Figure 3:
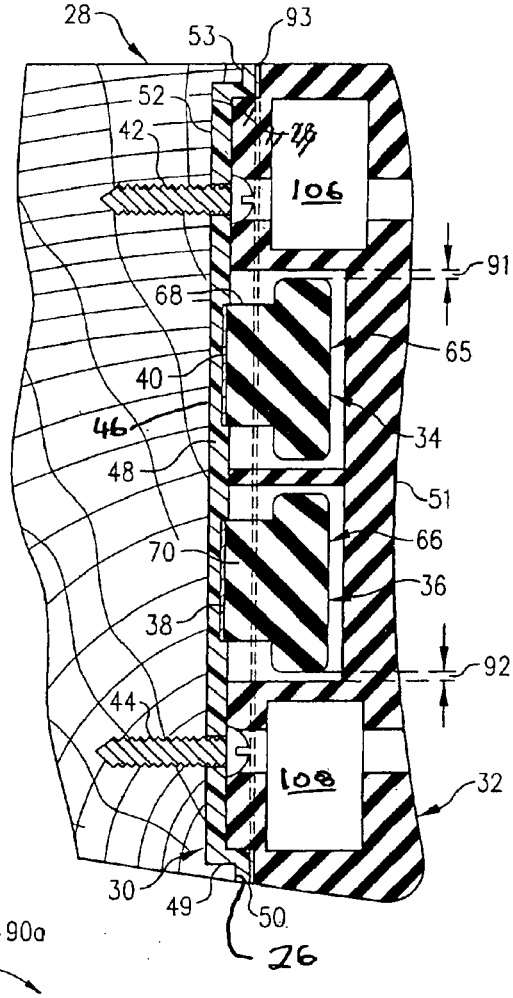
FIG. 3 is a section through the recoil reducing accessory and that butt end of the gunstock to which the accessory is attached.

Turning next to FIGS. 2 and 3, accessory 24 comprises a generally rigid, plastic or metal butt plate 30, an elastomeric pad 32, components 34 and 36 for modifying the decay pattern of the shock vibrations set up in stock 28 when gun 22 is fired, and double-adhesively-faced tabs 38 and 40 for attaching the vibration decay pattern modifying components 34 and 36 to accessory butt plate 30. The accessory 24 is attached to the butt end 26 of stock 28 by screws 42 and 44.

The butt plate 30 of accessory 24 has a flat base 48 which fits against the butt end 26 of gunstock 28, an integral side wall 49 extending around the periphery of base 48 and oriented at a right angle to that element, and a rim 50 which is integral with slit, wall 49 and extends around the periphery of the side wall at the edge thereof opposite the base.

Pad 32 can be fabricated from a variety of elastomeric materials. Preferred at the present time is the 522-2X material supplied by Oregon Rubber Company, Corvallis, Oreg. This material is a chloroprene polymer with a Durometer hardness of 20. Other elastomeric material with a Durometer hardness in the range of 12–30 can instead be employed, if desired.

Referring again to the drawings, elastomeric pad 32 has a monolithic element 51 and a second, integral element 52. Element 51 is contoured to complement the configuration of base plate rim 50.

Elements 51 and 52 define a ledge 53 extending around the periphery of pad 32. When the components of accessory 24 are assembled, elastomeric pad ledge 53 is seated on the rim 50 of accessory base plate 30. Pad element 52 extends into the cavity 54 defined by butt plate side wall 49, butts against base 46 of the butt plate, (see FIG. 3) and is surrounded by the butt plate side wall 49. This just described arrangement positively locates elastomeric pad 32 and base plate 30 relative to each other.

The exposed surface 56 of pad 32 has a convex shape in the transverse direction 58 with the same surface being concavely contoured in the longitudinal direction 60, falling off at toe 62, and tapering outwardly at heel 63 to conform surface 56 to the shoulder 64 of shooter 20.

Vibration decay pattern modifiers 34 and 36 are of like configuration, and both are fabricated of an elastomeric material, preferably that of which accessory pad 32 is made. The two accessory components 34 and 36 are of the mushroom-like configuration discussed above. This configuration is defined by a round head 65 (component 34) or 66 (component 36) and an integral, inline stem 68 (component 34) or 70 (component 34). Both the heads and the stems of the decay pattern modifiers have a circular cross-section.

Vibration decay pattern modifiers 34 and 36 are mounted to the base plate 30 of accessory 24 by the above-mentioned, adhesively faced tabs 38 and 40. These components are seated in complementary apertures 72 and 74 which are formed in the base 48 of accessory element 30 and are adhesively attached to the base.

The stems 68 and 70 of decay pattern modifiers 34 and 38 are then attached by the adhesive on the exposed sides of tabs 38 and 40. With the components 34 and 38 of accessory 24 assembled to butt plate 30, the heads 65 and 68 of those components fit in recesses 80 and 82. These recesses are formed in elastomeric accessory component 32 and open onto the surface 84 of that component.

Figure 3A:
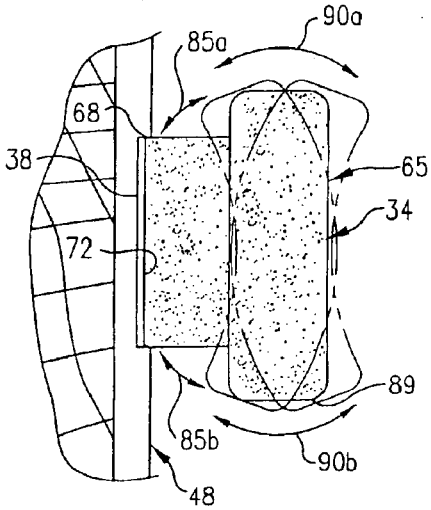
FIG. 3A is a fragment of FIG. 3, showing a very simplified pattern of the motions which a decay pattern modifier component of the FIG. 1 accessory manifests when a firearm equipped with the FIG. 1 accessory is fired.

The stems 68 and 70 of vibration decay pattern modifiers 34 and 38 can vibrate in directions generally normal to their longitudinal axes 80 and 82 (see arrows 85*a* and 85*b*, FIG. 3A) in any and all directions around the circumferences of the stems. At the same time, the peripheral edges 89 end 90 of decay pattern modifiers 34 and 38 can vibrate at loci around the circumference, of decay pattern modifier heads 85 and 68 in directions generally paralleling axis 86 and 88 (see arrows 90*a* and 90*b*, FIG. 3A). These several degrees of freedom of movement materially contribute to the effectiveness of accessory 24 in modifying the decay pattern of the shock vibration set up when gun 22 is fired as does the material from which the decay pattern modifiers are fabricated.

To accommodate the vibrations of components 34 and 36 just described for optimum effectiveness of accessory 24, the heads 65 and 66 of decay pattern modifiers 34 and 36 and the diameters of the cavities 72 and 74 in the elastomeric pad 32 are so relatively dimensioned that there is a gap (typically ca. one-sixteenth inch) between the decay pattern modifier head 65 or 66 and the companion elastomeric pad recess 72 or 74 around the circumference of the head (see arrows 91 and 92 in FIG. 3.) The width of this gap is, however, not critical; and it is acceptable if the vibrations of components of decay pattern modifiers of 34 and 36 cause them to touch elastomeric accessory pad 32 as they oscillate. This only causes energy to be transmitted to component 32 with a consequent, beneficial modification in the shock vibration decay pattern set up in stock 28 when gun 22 is fired.

Accessory 24 is assembled by first adhesively attaching shock vibration decay pattern modifiers 34 and 36 to accessory base plate 30 as described above. Next, the elastomeric pad component 32 of accessory 24 is assembled to base plate 30 with ledge 53 of the latter resting on rim 50 of the base plate, element 50 of the pad fitted in and surrounded by, side wall 52 of the base plate, the decay pattern modifying components 34 and 38 extending into elastomeric pad cavities 72 and 74, and the peripheral portions of the pad 32 and base plate 30 bonded together around their peripheral edges 89 and 90 by adhesive 92 (see FIG. 3). With this step completed, wall 48 of base plate 30 seals and isolates cavities 80 and 82.

Accessory 24 is fixed to the butt end 26 of gunstock 28 by installing fasteners 42 and 44 in apertures 94 and 96 in compressible accessory component 32 and then displacing the fasteners through apertures 98 and 100 in the base 48 of accessory base plate component 30. Next, the fasteners are threaded into apertures 102 and 104 in gunstock 28 and tightened.

As discussed above, the recoil or kick felt by shooter 20 when firearm 22 is discharged is reduced by virtue of vibration decay modifying components 34 and 36 oscillating as discussed above. In addition, this decay pattern modification is supplemented to some extent by the decay pattern modifiers 34 and 36 and to a greater extent by accessory component 32 due to the elastomeric properties of the material from which those components are fabricated.

Also, as mentioned above, kick is further reduced by the resilient compression of accessory component 32. In this regard, the cavities 80 and 82 which house decay pattern modifier heads 65 and 66 and cavities 106 and 108 in the path of threaded fastener-receiving apertures 102 and 104 "hollow out" the interior of component 32, significantly increasing the compressibility of that elastomeric component. A further contribution to the compressibility of component 32 is made by the parallel, extended ridge-and-groove structure 110 extending around the periphery of component 32.

In addition to the kick reduction afforded by vibration decay pattern modification and by the elastic compression of elastomeric component 32, the kick experienced by shooter 20 when firearm 22 is discharged is further reduced by the pneumatic compression of the air in sealed cavities 80 and 82, component 32 acting, in this regard, as a pneumatic spring.

Figure 4:
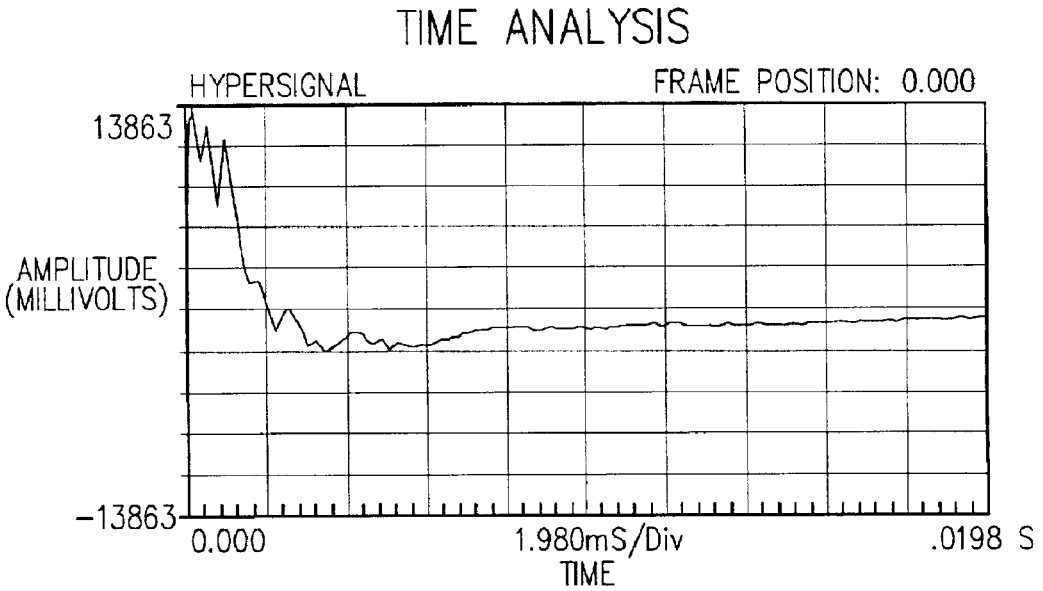
FIG. 4 shows, in graphical form, the decay in frequency, over time, of the recoil generated and transmittable to the shooter when a 12 gauge shotgun equipped with a conventional gun butt pad was fired.
Figure 5:
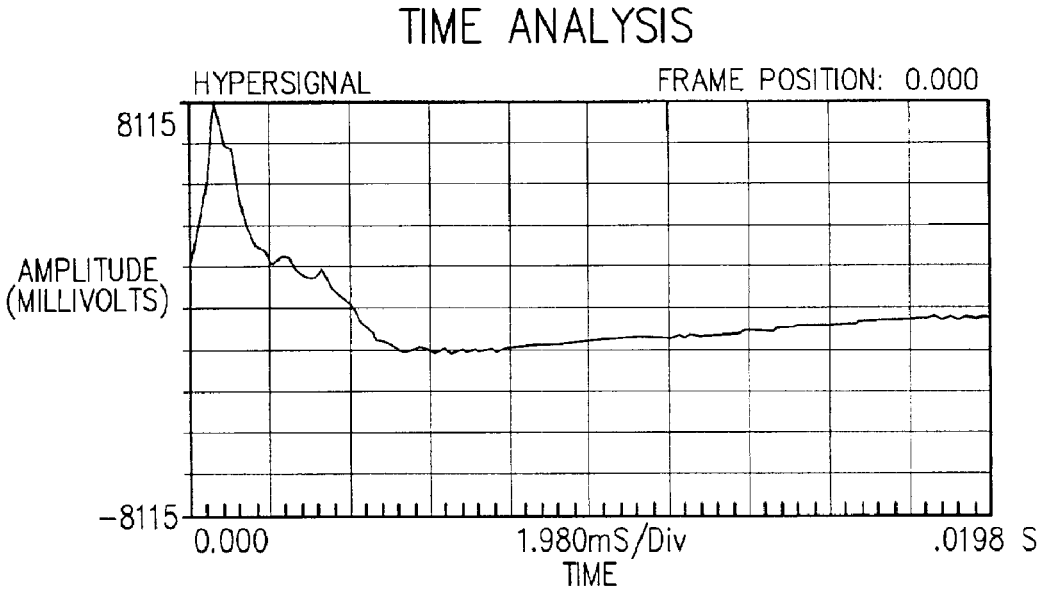
FIG. 5 is a graphic presentation similar to FIG. 4 but showing the marked reduction in recoil transmittable to the shooter when the same gun loaded with the same ammunition but with the accessory of FIG. 1 was fired.
Figure 6:
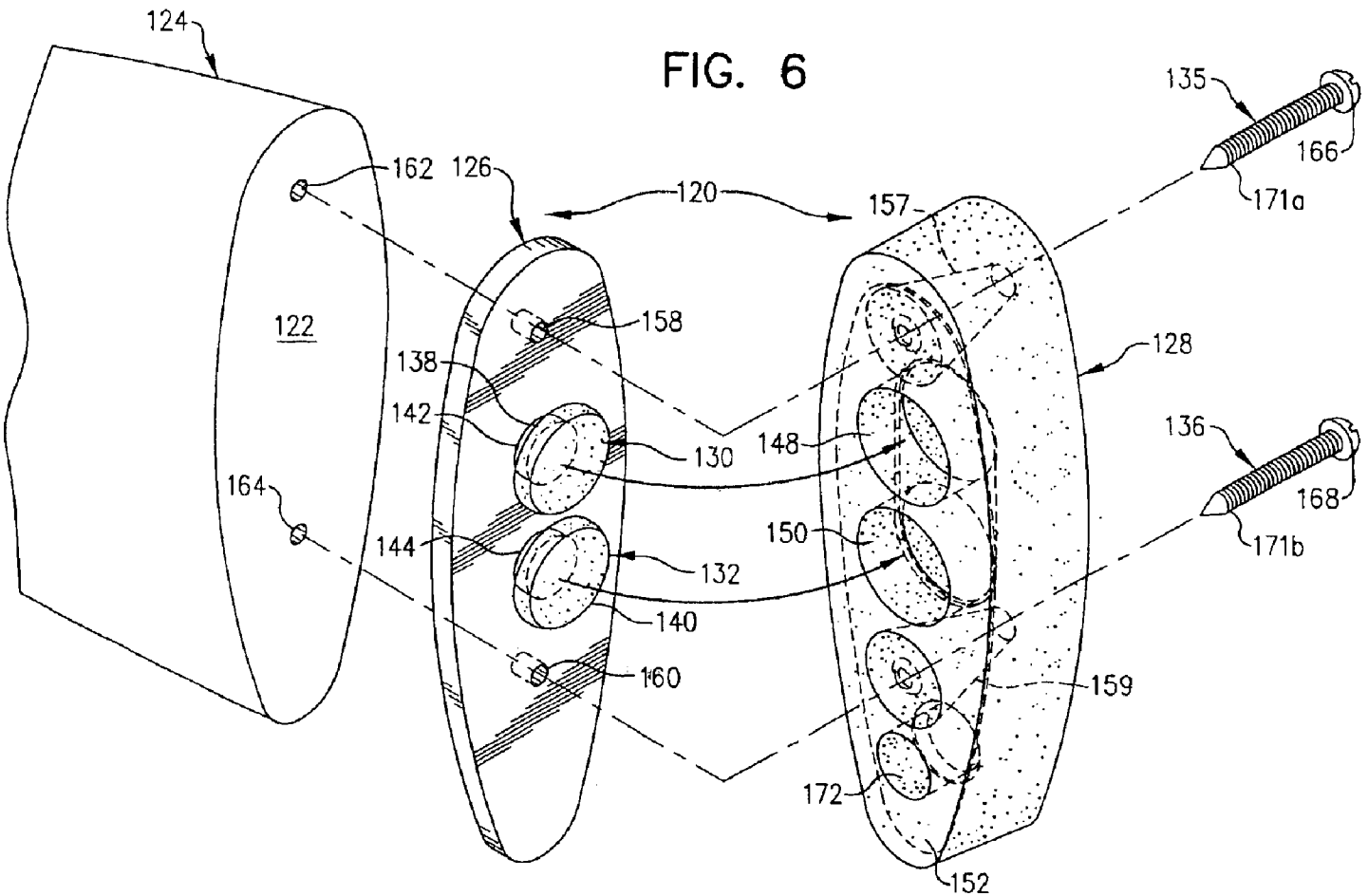
FIG. 6 is an exploded view of a second accessory embodying the principles of the present invention and the butt end of the gunstock to which that accessory is attached.

The efficacy of the accessory 24 described above can be readily visualized by comparing the time analysis of FIG. 4 (stock with a conventional butt pad) with the time analysis of FIG. 5 (accessory 24). A 41% reduction in the magnitude of the strongest shock vibration generated when the shotgun was discharged (13863 to 8115 millivolts) was obtained by using accessory 24, significantly reducing the kick of the firearm felt by shooter 20. Furthermore, 0.12 milliseconds after firearm 22 was discharged, the shooter using gun 22 with the conventional pad (FIG. 4) was still experiencing shock vibrations with a high magnitude, the amplitude of the shock vibrations only having decayed a few hundred millivolts, and the recoil accordingly remaining at a high level. In contrast, over this same time span, the amplitude of the shock vibrations experienced by the shooter with gun 22 instead equipped with accessory 24 had decayed almost 5000 millivolts, sharply reducing the kick felt by the shooter.

A second recoil reducing accessory for firearms is depicted in FIGS. 6–9 and identified by reference character 120. Like the accessory 24 described above, recoil reducer 120 has a rigid butt plate, an elastomeric pad, and mushroom-shaped, shock vibration decay pattern modifiers. This accessory is fixed to the butt end 122 of gunstock 124 by threaded fasteners. The butt plate is identified by reference character 128, the elastomeric pad by reference character 128, the shock vibration decay pattern modifiers by reference characters 130 and 132, and the threaded fasteners by reference characters 134.

In the FIGS. 6–9 embodiment of the invention, component 126 is a rigid flat plate configured to match the contour of gunstock butt end 122. Like the corresponding component 30 of accessory 24, butt plate 126 may be fabricated from any appropriate plastic or metal.

The elastomeric pad 128 has essentially the same peripheral configuration as butt plate 126. This component, like its counterpart 32 of accessory 24, is preferably, but not necessarily, fabricated from the elastomeric chloroprene polymer identified above.

Shock vibration decay pattern modifying components 130 and 132 are preferably made of the same chloroprene material. These components have heads 138 and 140 and integral stems 142 and 144 with the stems being adhesively bonded or otherwise securely attached to butt plate 126.

With the butt plate 126 and elastomeric pad 128 of accessory 120 assembled (FIGS. 7 and 8), decay pattern modifiers 130 and 132 are situated in cavities 148 and 150 of elastomeric pad 128. These cavities open onto the butt plate-adjacent surface 152 of the elastomeric pad and are dimensioned such that the decay pattern modifiers 130 and 132 have the freedom of movement discussed above in conjunction with the decay pattern modifiers 34 and 36 of accessory 24, (See the simplified motion pattern of FIG. 9 in which the wobbling motion of decay pattern modifier 130 about its longitudinal axis 155*a* is suggested by arrows 155*b* and 155*c* and the flip flop movements of the modifier head peripheral edge 155*d* by arrows and 155*e* and 155*f*). Decay pattern modifier 132 exhibits a similar pattern of movement.

Figure 7:
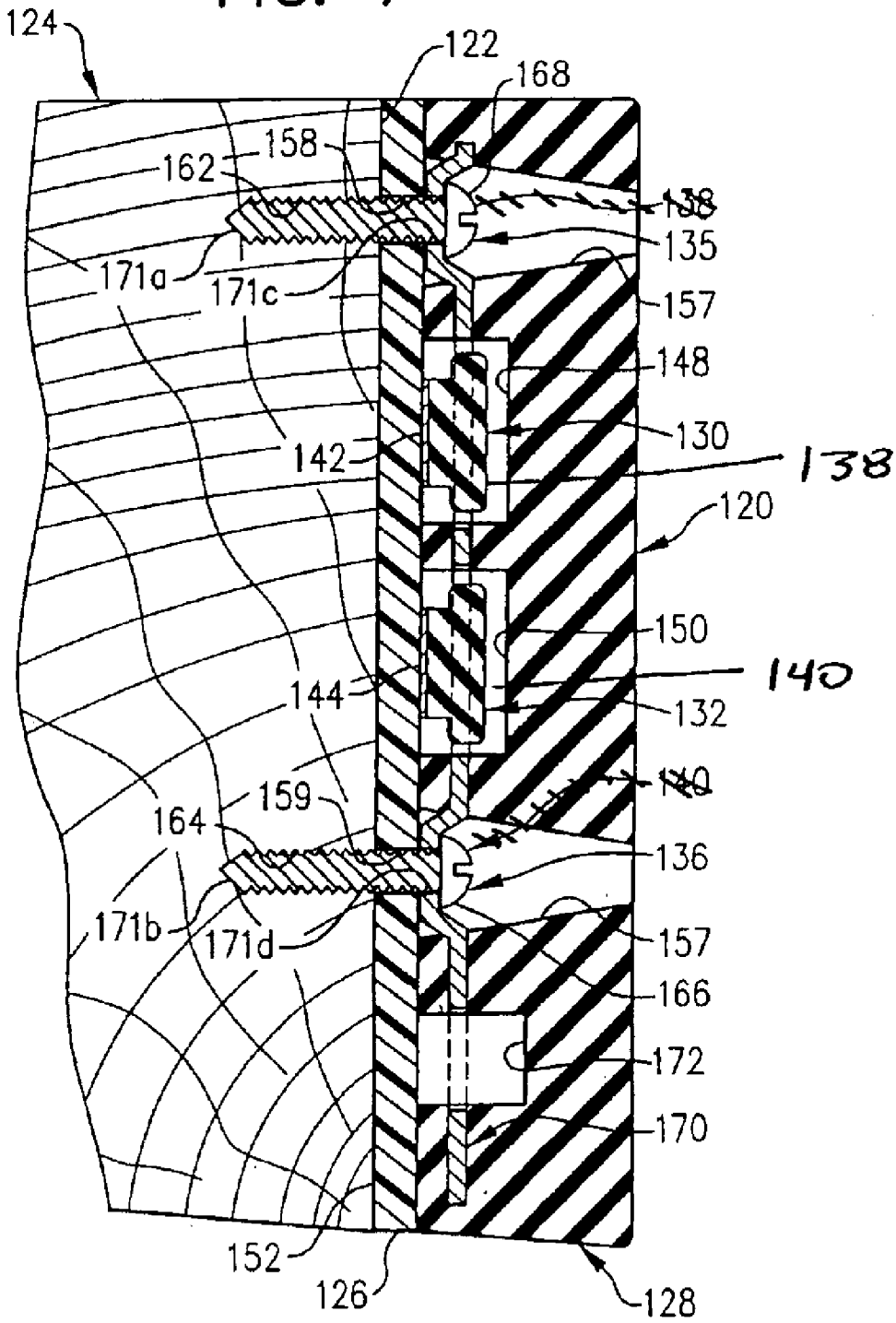
FIG. 7 is a section through the FIG. 6 accessory and the butt end of the gunstock.
Figure 8:
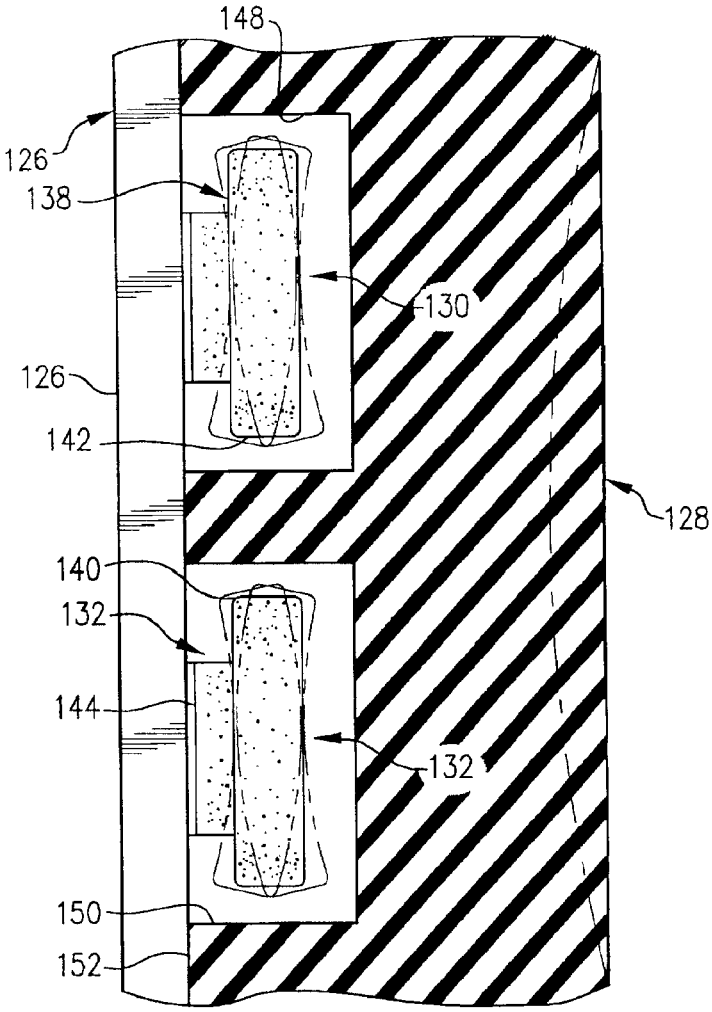
FIG. 8 is a fragment of FIG. 7, drawn to an enlarged scale to show how certain decay pattern modifying components of the FIG. 6 accessory function.
Figure 9:
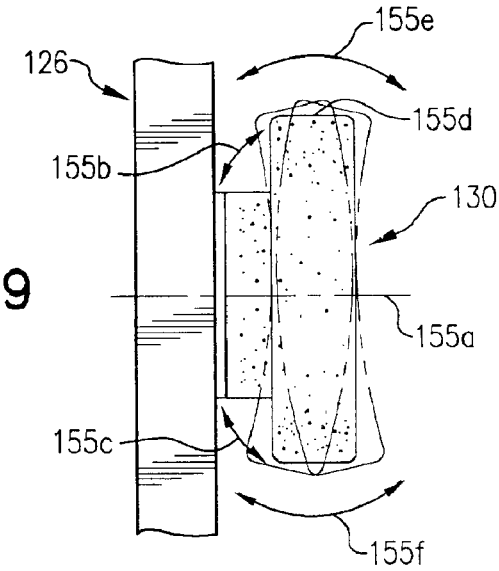
FIG. 9 is a view like FIG. 3A showing the character of motions of which a decay pattern modifier as shown in FIGS. 7 and 8 is capable.

Referring now most particularly to FIG. 7, recoil reducing accessory 120 is installed by locating its rigid plate 126 on the butt end 122 of gunstock 124; placing the elastomeric pad 128 of the accessory on butt plate 126; displacing fasteners 135 and 136 through the elastomeric pad and the rigid plate; and then threading the fasteners into the butt end 122 of gunstock 124. The screws are tightened to hold the components of the accessory together and to secure the accessory to the gunstock.

Referring now specifically to FIG. 7, screw 135 is installed through an opening 157 in elastomeric pad 128 and an aperture 158 through butt plate 126; and screw 136 is similarly installed through an aperture 159 in elastomeric pad 128 and a through aperture 160 in the butt plate.

The holes in gunstock 124 into which the fasteners are threaded are identified by reference characters 162 and 164. As shown in FIG. 7, the heads 166 and 168 of the two fasteners 135 and 138 are seated en an elongated, metal or plastic mounting plate 170 molded into elastomeric pad 128 with the shanks 171*a* and 171*b* of fasteners 136 and 136 extended through apertures 171*c* and 171*d* in plate 170 (see FIG. 7). Mate 170 is employed because the elastomeric pad material is too soft to support screw heads 166 and 168. The screw heads would simply tear through the material as screws 135 and 136 were tightened, or, if they did not, the elasticity of the material would make it impossible to effect an unyielding connection between accessory 120 and gunstock 124; and the accessory would not function effectively, if at all. By using the mounting plate 170 and so positioning it in pad 128 that the plate butts against the butt end 122 of gunstock 124 (FIG. 7), the wanted rigid connection is made, while leaving pad 128 free to perform its vibration decay pattern modifying and cushioning functions.

Continuing still with FIG. 7, the screw accommodating apertures 157 and 159 in elastomeric pad 128 have a diameter much larger than is needed to accommodate fasteners 135 and 136; and a third cavity 172 of significant size is formed in elastomeric pad 128 in line with apertures 157 and 159. The three apertures or cavities just mentioned along with the cavities 148 and 150 in which the shock vibration decay pattern modifiers 130 and 132 are housed "hollow out" the elastomeric pad. This, like the comparable treatment of the accessory 20 elastomeric pad 32, increases the compressibility of the pad and, as a consequence, the cushioning effect of which that pad is capable.

Figure 12:
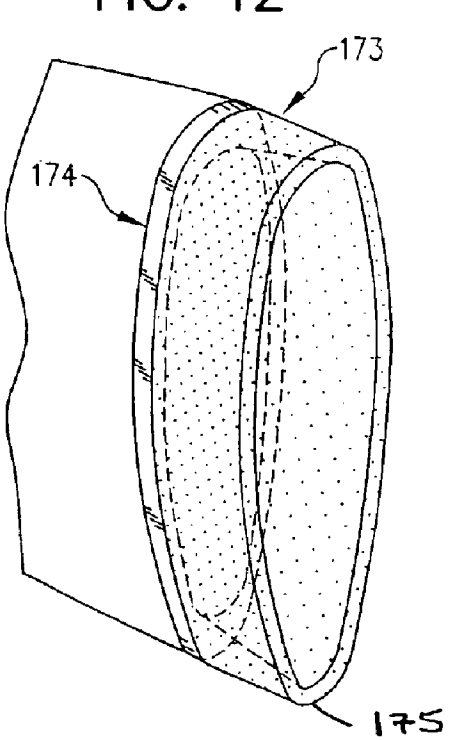
FIG. 12 shows the gunstock and assembled accessory after the shaping operation is completed.
Figure 11:
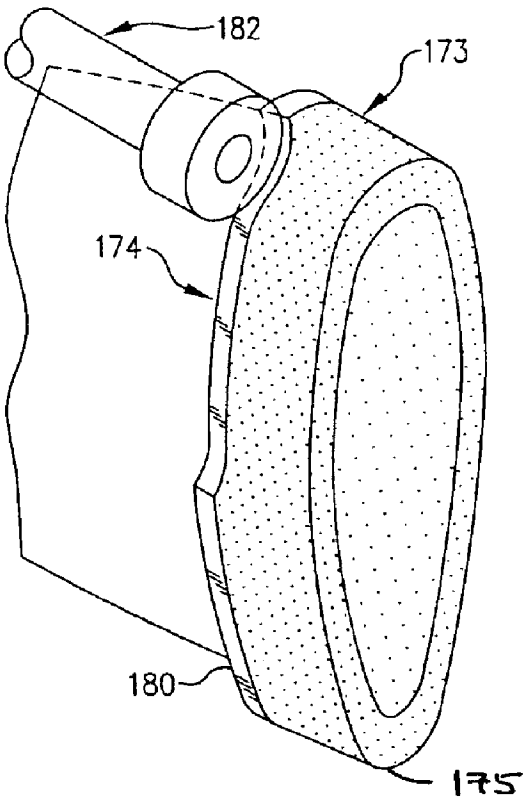
FIG. 11 is similar to FIG. 12 but shows a rotary tool being employed to match the contour of the accessory to that of the gunstock.
Figure 10:
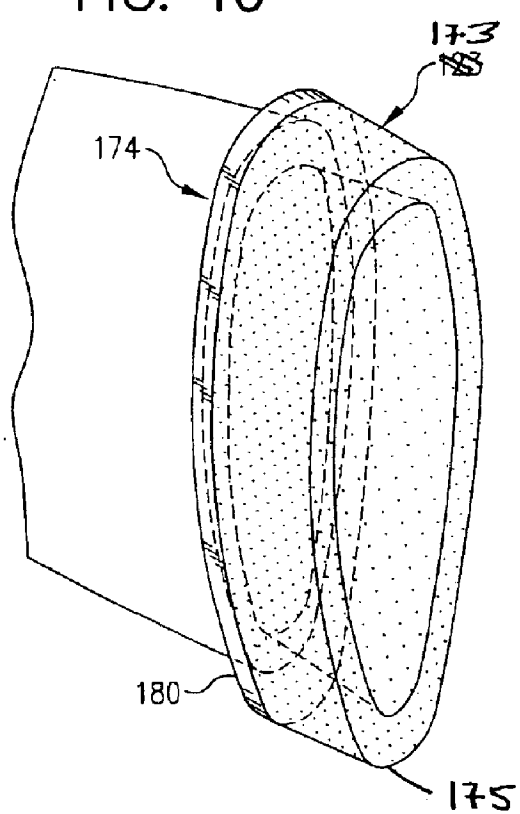
FIG. 10 is a pictorial view of a third recoil reducing accessory embodying the principles of the present invention; this accessory is designed to be assembled to any one of a variety of gunstocks; this figure also shows a representative gunstock to which the accessory is attached.

Recoil reducing accessories of the character just discussed and illustrated in FIGS. 6–9 are designed to fit a particular gun butt. FIGS. 10–12 show another recoil reducing accessory of the same character as the one just described, but designed with a "one size fits all" approach in mind. This recoil reducing accessory is identified in the drawings by reference character 173; and, like the accessories described above, it has a rigid base or butt plate 174 and an elastomeric pad 175.

In this embodiment of the invention, the rigid butt plate 174 is dimensioned to overlap the butt end of the stock of any of a variety of guns to which accessory 170 might be attached with threaded fasteners (not shown) installed through elastomeric pad 175. Accessory 173 also has mushroom-shaped vibration decay pattern modifiers like those disclosed above and in the drawings and identified by reference characters 30, 32 and 130, 132. These components are hidden from view in FIGS. 10–12.

Once accessory 173 is fixed to gunstock 176, that peripheral portion 180 of butt plate 174 protruding beyond the contours of gunstock 176 is removed, typically with a rotary tool 182 shown schematically in FIG. 11. This leaves accessory 170 with its butt plate 174 matching the configuration of gunstock 176 as shown in FIG. 12.

The one size fits all innovation can also be used in accessories which are otherwise of the construction illustrated in FIGS. 1–3.

Figure 13:
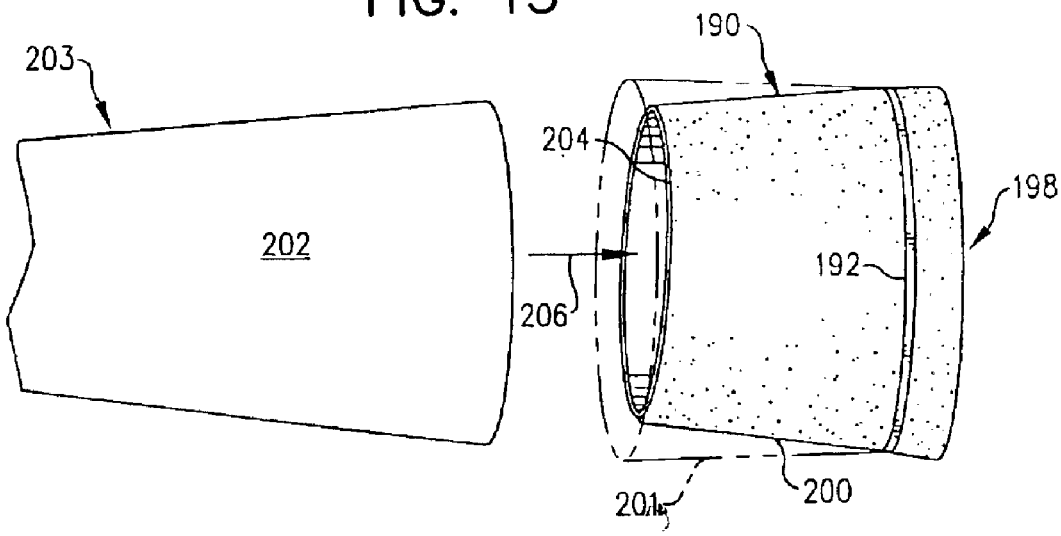
FIG. 13 is an exploded view of a fourth recoil reducing accessory embodying the principles of the present invention and the butt end of a gunstock; in this case, the accessory is designed to be installed by slipping it over the butt end of the gunstock.
Figure 14:
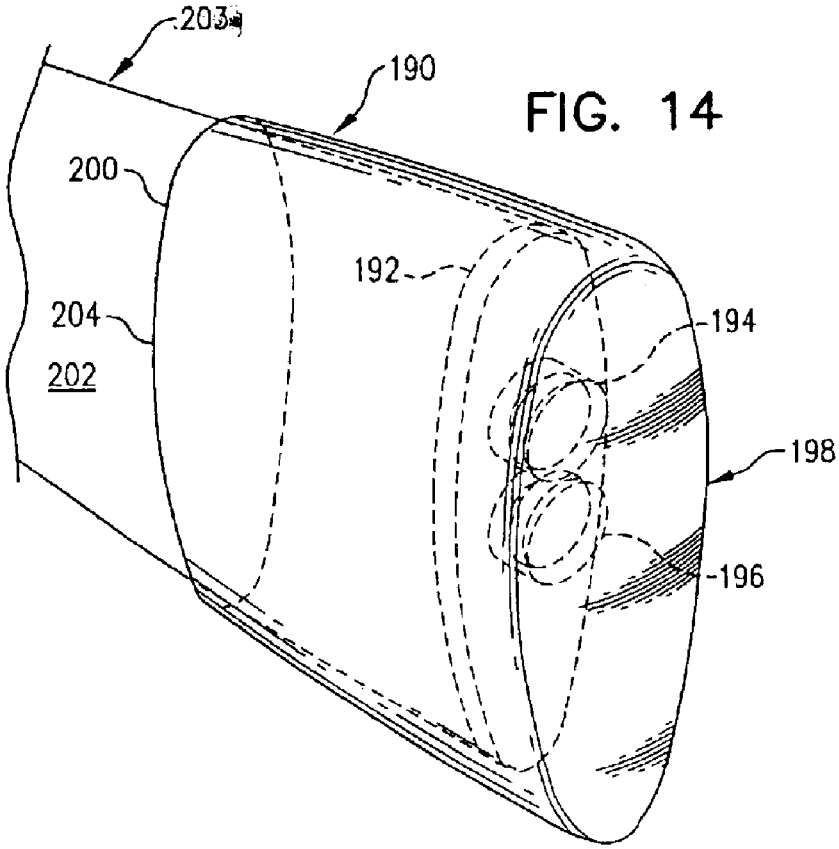
FIG. 14 is a perspective view of the FIG. 13 gunstock and installed accessory.

Yet another recoil reducing accessory used of the present invention is illustrated in FIGS. 13 and 14 and identified by reference character 190.

Accessory 190 has a rigid plate 192, decay pattern modifiers 194 and 196, and an elastomeric pad 198, all of the character discussed above in conjunction with FIGS. 1–3 and 6–9. This accessory also has a boot or sleeve 200 adhesively bonded or otherwise fixed to plate 192 on the side of that component opposite elastomeric pad 198.

Rather than being fastened to gunstock 202 with srews as in the previously described embodiments of the present invention, accessory 190 is installed by first stretching boot 200 as suggested by phantom line 201 in FIG. 13 and then sliding the butt end 200 of the gunstock into the open end 204 of the boot 202 as shown by arrow 206. The assembled accessory 190 and gunstock 203 are shown in FIG. 14.

Sleeve 196 is typically fabricated from the same elastomeric material as the elastomeric pad 198, in which case friction will securely keep the installed accessory 190 in place on the gunstock.

The invention may be embodied in many forms without departing from the spirit or essential characteristics of the invention. The present embodiments are therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed is:

1. An accessory for reducing the kick felt by a shooter when a firearm is discharged, said accessory comprising:

a pad, a rigid plate, and a vibration decay pattern modifier;

said pad and said decay pattern modifier both being fabricated from an elastomeric material;

said pad having therein an aperture opening onto a face of the pad;

said plate being assembled in face-to-face relationship with that face of the pad onto which the aperture in the pad opens;

the decay pattern modifier being disposed in the aperture in the elastomeric pad;

there being a space between an end of the vibration decay pattern modifier and a complementary end of the aperture in which the decay pattern modifier is disposed; and the decay pattern modifier having an element with the capability of so oscillating into the space in the aperture as to reduce the amplitude of vibrations transmitted to the recoil pad and the duration of those vibrations.

2. An accessory as defined in claim 1 in which the vibration decay pattern modifier has a mushroom-like configuration defined by a stem and an integral head.

3. An accessory as defined in claim 1 in which said material has a Durometer hardness in the range of 12 to 30.

4. An accessory as defined in claim 1 wherein:

said pad has a cavity with an opening onto one face of the pad; and said plate is so disposed in face-to-face relationship with the pad as to close said opening and form a sealed and isolated aperture that can collapse when the firearm is discharged, additionally reducing the kick felt by the shooter upon the discharge of the firearm.

5. An accessory as defined in claim 1 in which there is an additional sealed decay pattern modifier-free cavity in said pad further contributing to the cushioning afforded by the accessory when the firearm is discharged.

6. An accessory as defined in claim 1 in which there is a clearance around the periphery of the decay pattern modifier between that periphery and the boundary of the aperture in which said decay pattern modifier is disposed.

7. An accessory as defined in claim 1 in which the elastomeric pad is hollowed out by at least one vibration decay pattern modifier-free cavity to increase the kick-reducing effect offered by said pad.

* * * * *